US010439278B2

(12) United States Patent
Chang

(10) Patent No.: US 10,439,278 B2
(45) Date of Patent: Oct. 8, 2019

(54) ANTENNA DEVICE

(71) Applicant: AMBIT MICROSYSTEMS (SHANGHAI) LTD., Shanghai (CN)

(72) Inventor: Wei-Jen Chang, New Taipei (TW)

(73) Assignee: AMBIT MICROSYSTEMS (SHANGHAI) LTD., Shanghai (CN)

( * ) Notice: Subject to any disclaimer, the term of this patent is extended or adjusted under 35 U.S.C. 154(b) by 0 days.

(21) Appl. No.: 15/665,444

(22) Filed: Aug. 1, 2017

(65) Prior Publication Data

US 2019/0036211 A1 Jan. 31, 2019

(30) Foreign Application Priority Data

Jul. 27, 2017 (CN) ..... 2017 1 0625385

(51) Int. Cl.

| | |
|---|---|
| ***H01Q 1/24*** | (2006.01) |
| ***H01Q 1/52*** | (2006.01) |
| ***H01Q 1/38*** | (2006.01) |
| ***H01Q 1/48*** | (2006.01) |
| ***H01Q 21/28*** | (2006.01) |

(52) U.S. Cl.

CPC ..... *H01Q 1/521* (2013.01); *H01Q 1/38* (2013.01); *H01Q 1/48* (2013.01); *H01Q 21/28* (2013.01)

(58) Field of Classification Search

CPC ..... H01Q 1/243; H01Q 1/38; H01Q 21/28; H01Q 9/0421; H01Q 1/521; H01Q 5/371; H01Q 13/10; H01Q 1/22; H01Q 1/42; H01Q 9/04; H01Q 9/0407; H01Q 9/0457; H01Q 1/241; H01Q 21/065; H01Q 23/00; H01Q 9/0428

USPC ..... 343/700 MS, 702, 835

See application file for complete search history.

(56) References Cited

U.S. PATENT DOCUMENTS

| | | | | |
|---|---|---|---|---|
| 8,957,827 | B1 * | 2/2015 | Lee | H01Q 5/321 343/700 MS |
| 9,583,838 | B2 * | 2/2017 | Zhu | H01Q 13/10 |
| 2010/0156745 | A1 | 6/2010 | Andrenko et al. | |
| 2010/0238079 | A1 * | 9/2010 | Ayatollahi | H01Q 1/243 343/729 |

(Continued)

FOREIGN PATENT DOCUMENTS

| | | | |
|---|---|---|---|
| CN | 103401061 | A | 11/2013 |
| CN | 104241852 | A | 12/2014 |

(Continued)

*Primary Examiner* — Linh V Nguyen

(74) *Attorney, Agent, or Firm* — ScienBiziP, P.C.

(57) ABSTRACT

An antenna device includes a first antenna, a second antenna, a main short portion and a grounding portion. The first antenna and the second antenna are disposed in a PCB to radiate signals. The main short portion is disposed between the first antenna and the second antenna. The main short portion is further electrically coupled to the grounding portion. The main short portion adjusts current between the first antenna and the second antenna. Thus, the main short portion reduces interference between the first antenna and the second antenna. The first antenna includes a first feeding portion, a first short portion and a first coupling portion. A first end of the first feeding portion is suspended in the air. The first coupling portion is disposed in a first storage space. The first coupling portion is electrically insulated from the first short portion and the grounding portion.

15 Claims, 3 Drawing Sheets

(56) References Cited

U.S. PATENT DOCUMENTS

| | | | | |
|---|---|---|---|---|
| 2013/0016024 | A1 | 1/2013 | Shi et al. | |
| 2013/0078938 | A1* | 3/2013 | Motoyama | H04H 40/90 455/311 |
| 2013/0162496 | A1 | 6/2013 | Wakabayashi | |
| 2013/0314297 | A1* | 11/2013 | Hamabe | H01Q 21/28 343/893 |
| 2014/0198012 | A1* | 7/2014 | Tseng | H01Q 21/28 343/876 |
| 2015/0054712 | A1* | 2/2015 | Milyakh | H01Q 1/3233 343/893 |
| 2015/0061962 | A1* | 3/2015 | Lee | H01Q 9/42 343/893 |
| 2015/0109182 | A1* | 4/2015 | Chen | H01Q 1/525 343/841 |
| 2015/0180118 | A1* | 6/2015 | Huang | H01Q 1/526 343/841 |
| 2016/0093949 | A1* | 3/2016 | Chang | H01Q 1/526 343/841 |
| 2017/0077599 | A1* | 3/2017 | Sayama | H01Q 1/523 |

FOREIGN PATENT DOCUMENTS

| | | |
|---|---|---|
| TW | I256179 | 6/2006 |
| TW | 201017978 A | 5/2010 |

* cited by examiner

ANTENNA DEVICE

FIELD

The subject matter herein generally relates to wireless communication field, particularly relates to an antenna device.

BACKGROUND

Thin and short communication devices are becoming more popular. Communication systems have to be designed within a limited amount of spaces. For example, a communication system with a plurality of antennas has to be designed in a small space. However, when two antennas are designed in the same small space, interference between the two antennas would be huge if isolation between the two antennas is not sufficient. Thus, signal transmission is affected and transmission rate may be reduced as well. Moreover, it is easy to generate current interference near an edge of the ground when two antennas are disposed in two sides of the ground. Improvement in the art is preferred.

BRIEF DESCRIPTION OF THE DRAWING

Implementations of the present disclosure will now be described, by way of example only, with reference to the attached figures, wherein.

DETAILED DESCRIPTION

Figure 1:
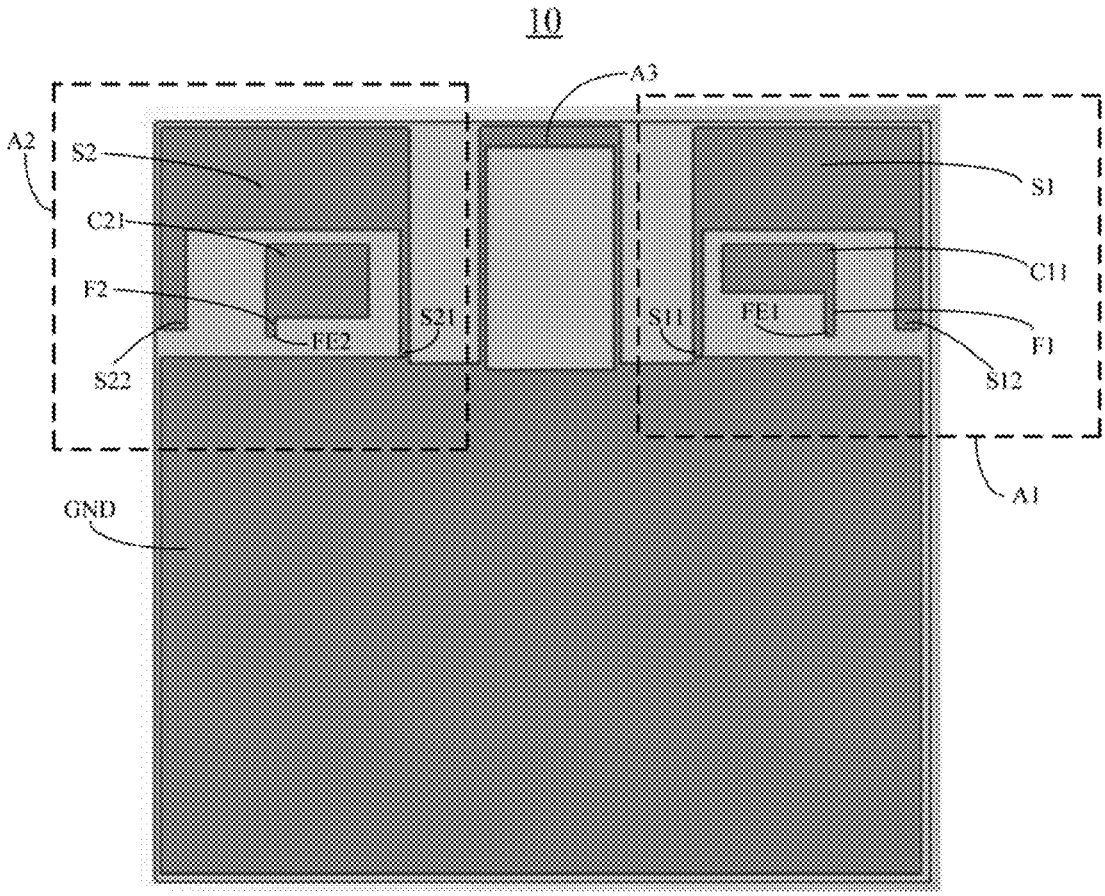
FIG. 1 is a diagram illustrating an exemplary embodiment of a communication device.

It will be appreciated that for simplicity and clarity of illustration, where appropriate, reference numerals have been repeated among the different figures to indicate corresponding or analogous elements. In addition, numerous specific details are set forth to provide a thorough understanding of the exemplary embodiments described herein. However, it will be understood by those of ordinary skill in the art that the exemplary embodiments described herein can be practiced without these specific details. In other instances, methods, procedures, and components have not been described in detail so as not to obscure the related relevant feature being described. Also, the description is not to be considered as limiting the scope of the exemplary embodiments described herein. The drawings are not necessarily to scale, and the proportions of certain parts have been exaggerated to illustrate details and features of the present disclosure better. The disclosure is illustrated by way of example and not by way of limitation in the figures of the accompanying drawings in which like references indicate similar elements. It should be noted that references to "an" or "one" exemplary embodiment in this disclosure are not necessarily to the same exemplary embodiment, and such references mean at least one.

Several definitions that apply throughout this disclosure will now be presented. The term "coupled" is defined as connected, whether directly or indirectly through intervening components, and is not necessarily limited to physical connections. The connection can be such that the objects are permanently connected or releasably connected. The term "comprising," when utilized, means "including, but not necessarily limited to"; it specifically indicates open-ended inclusion or membership in the so-described combination, group, series and the like.

Figure 2:
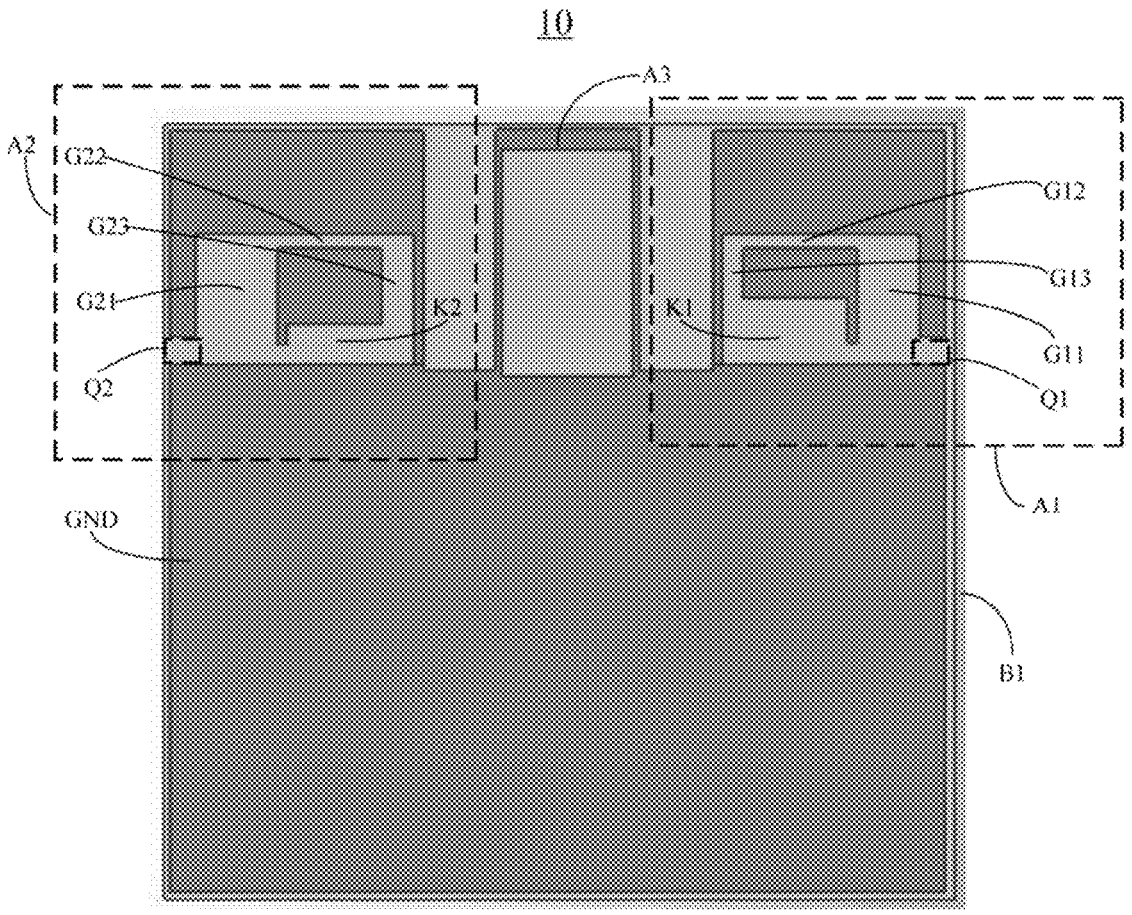
FIG. 2 is another diagram illustrating the exemplary embodiment of the antenna device.

FIG. 1-2 are diagrams illustrating an exemplary embodiment of the antenna device 10. FIG. 1 and FIG. 2 use different labels to annotate the same exemplary embodiment of the communication device 10.

The antenna device 10 mainly operates in Institute of Electrical and Electronics Engineers (IEEE) 802.11 a/b/g/n/ac frequency bands. The antenna device 10 comprises a first antenna A1, a second antenna A2, a grounding portion GND, and a main short portion A3. The first antenna A1 and the second antenna A2 are both disposed in the PCB B1 to radiate signals.

In the exemplary embodiment, the first antenna A1 and the second antenna A2 are disposed in different regions of the PCB B1. A distance between the first antenna A1 and the second antenna A2 is very small, special designed structure in the first antenna A1 and the second antenna A2 to improve isolation is preferred. Thus, the interference between the first antenna A1 and the second antenna A2 can be prevented and ground conduction current between the first antenna A1 and the second antenna A2 can be reduced.

The first antenna A1 comprises a first coupling portion C11, a first short portion S1 and a first feeding portion F1. A first end of the first feeding portion F1 is suspended in the air. The first short portion S1 and the grounding portion GND are electrically coupled to form a first storage space K1. Further, the first storage space K1 has a first notch Q1. The first notch Q1 has a rectangle shape. The first coupling portion C11 is in the first storage space K1. The first coupling portion C11 is electrically insulated from the first short portion S1 and the grounding portion GND. In the exemplary embodiment, the first feeding portion F1 has a strip shape. A first end of the first feeding portion F1 is suspended in the air. The first end of the first feeding portion F1 is the first feeding point FE1 for signal feeding. The first short portion S1 has an arch shape. A first end S11 of the first short portion S1 is electrically coupled to the grounding portion GND. A second end S12 of the first short portion S1 is suspended in the air. Thus, the first storage space K1 is formed. A corner of the first coupling portion C11 is electrically coupled to a second end of the first feeding portion F1. In the exemplary embodiment, the first coupling portion C11 has a square shape. In other exemplary embodiment, the first coupling portion C11 can have another shape according to a size of first storage space K1.

The first feeding portion F1 is also disposed in the first storage space K1. The first feeding portion F1 is configured to input the signal to the first coupling portion C11. In the first storage space K1, edges of the first coupling portion C11 and the first short portion S1 form gaps therebetween. Signals near edges of the first coupling portion C11 and signals in the first short portion S1 are coupled together. Thus, the first antenna A1 has a smaller size because of the signals coupling together. In the exemplary embodiment, the first short portion S1 has an arch shape. The square shaped first coupling portion C11 and the first short portion S1 together form gaps G11, G12, and G13 therebetween. Signals near the gaps G11, G12, and G13 are coupled together. The less amount the signals coupling together, the higher a resonance frequency of the first antenna A1. The more amount the signals coupling together, the lower the resonance frequency of the first antenna A1. The amount of the signals coupling can affect the size of the first antenna A1.

Referring to FIGS. 1 and 2, the second antenna A2 comprises the second coupling portion C21, the second short portion S2 and the second feeding portion F2. A first end of the second feeding portion F2 is suspended in the air. The second short portion S2 and the grounding portion GND are electrically coupled together to form a second storage space K2. The second storage space K2 has a second notch Q2. The second notch Q1 has a rectangle shape. The second coupling portion C21 is disposed in the second storage space K2. The second coupling portion C21 is electrically insulated from the second short portion S2, and the grounding portion GND. In the exemplary embodiment, the second feeding portion F2 has a strip shape. A first end of the second feeding portion F2 is also suspended in the air. The first end of the second feeding portion F2 is a second feeding point FE2 for signal feeding. The first feeding portion F1 and the second feeding portion F2 are parallel to each other. The second short portion S2 has an arch shape. A first end S21 of the second short portion S2 is electrically coupled to the grounding portion GND. A second end S22 of the second short portion S2 is suspended in the air. Thus, the second storage space K2 is formed. A corner of the second coupling portion C21 is electrically coupled to a second end of the second feeding portion F2. In the exemplary embodiment, the second coupling portion C21 is has square shape. In other exemplary embodiment, the second coupling portion C21 can have another shape according to a size of the second storage space K2.

The second feeding portion F2 is also disposed in the second storage space K2. The second feeding portion F2 is configured to input the signal to the second coupling portion C21. In the second storage space K2, edges of the second coupling portion C21 and the second short portion S2 form gaps. Signals near edges of the second coupling portion C21 and signals in the second short portion S2 are coupled together. Thus, the second antenna A2 has a smaller size because of the signals coupling together. In the exemplary embodiment, the second short portion S2 has an arch shape. The second coupling portion C21 and the second short portion S2 together form gaps G21, G22, G23. Signals near the gaps G21, G22, G23 are coupling together. The less amount the signals coupling together, the higher a resonance frequency of the second antenna A2. The more amount the signals coupling together, the lower the resonance frequency of the second antenna A2. The amount of the signals coupling can affect the size of the second antenna A2. The main short portion A3 also has an arch shape. Two ends of the main short portion A3 are electrically coupled to the grounding portion GND. The main short portion A3 can reduce current interference of edges of the grounding portion GND, and the main short portion A3 also can reduce interference when antennas are radiating signals. In the exemplary embodiment, the main short portion A3 is disposed between the first antenna A1 and the second antenna A2. The main short portion A3 is also electrically coupled to the grounding portion GND. As the main short portion A3 is disposed between the first antenna A1 and the second antenna A2, the main short portion A3 adjusts current between the first antenna A1 and the second antenna A2. Thus, the main short portion A3 reduces interference between the first antenna A1 and the second antenna A2. Namely, the main short portion A3 reduces the current interference of an edge of the grounding portion GND. The edge of the grounding portion GND is between the first end S11 of the first short portion S1, and the first end S21 of the second short portion S2.

Figure 3:
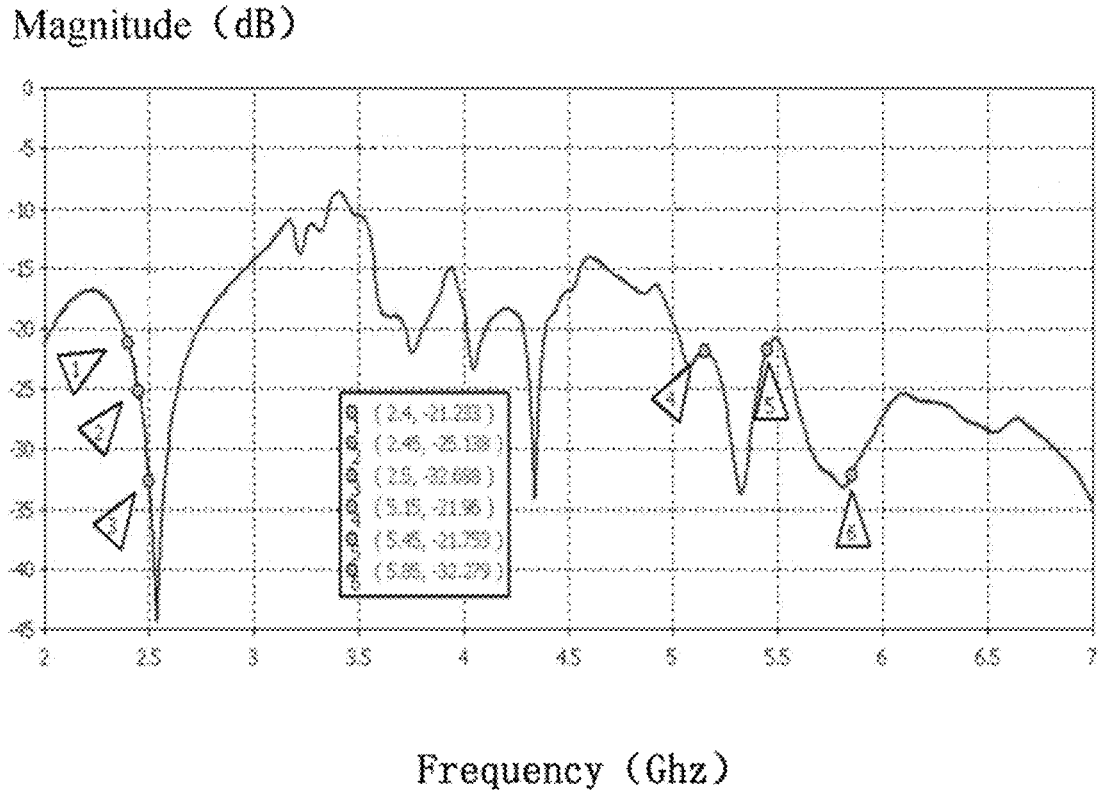
FIG. 3 is an isolation measurement diagram of an exemplary embodiment of the antenna device.

FIG. 3 is an isolation measurement diagram of an exemplary embodiment of the antenna device.

As shown in FIG. 3, an isolation curve is shown in FIG. 3. For example, an abscissa of a first measurement point in the curve is 2.4 GHz, an ordinate of a first measurement point in the curve is −21.233 dB. When an abscissa is 2.45 GHz, the isolation shown in the curve is −25.138 dB. When an abscissa is 5.45 GHz, the isolation shown in the curve is −21.753 dB. Therefore, comparing with those antennas only with −10 dB isolation, the antenna device 10 has a better performance. The antenna device 10 is beneficial to reduce ground edge current interference. Further, the antenna device 10 is also beneficial in improving isolation between two antennas.

Many details are often found in art including other features of the antenna device. Therefore, many such details are neither shown nor described. Even though numerous characteristics and advantages of the present disclosure have been set forth in the foregoing description, together with details of the structure and function of the present disclosure, the disclosure is illustrative only, and changes may be made in the detail, especially in matters of shape, size, and arrangement of the parts within the principles of the present disclosure, up to and including the full extent established by the broad general meaning of the terms used in the claims. It will, therefore, be appreciated that the exemplary embodiments described above may be modified within the scope of the claims.

What is claimed is:

1. An antenna device, comprising:

a first antenna in a PCB to radiate signals;

a second antenna in the PCB to radiate signals;

a grounding portion; and a main short portion between the first antenna and the second antenna, the main short portion electrically coupled to the grounding portion; wherein the main short portion adjusts current between the first antenna and the second antenna, thereby the main short portion reduces interference between the first antenna and the second antenna;

wherein the first antenna comprises:

a first feeding portion, the first feeding portion comprising a first end, the first end being a free end;

a first short portion comprising a first terminal electrically coupled to the grounding portion, and a second terminal, the second terminal being a free end, wherein a first notch is defined between the second terminal and the grounding portion, and a first storage space is defined and enclosed by the first short portion, the first notch and the grounding portion; and a first coupling portion; wherein the first coupling portion is received in the first storage space, a corner of the first coupling portion is electrically coupled to a second end of the first feeding portion, and the first coupling portion is electrically insulated from the first short portion and the grounding portion;

wherein the second antenna comprises:

a second feeding portion, the second feeding portion comprising a first end, the first end being a free end;

a second short portion comprising a third terminal electrically coupled to the grounding portion, and a fourth terminal, the fourth terminal being a free end, wherein a second notch is defined between the fourth terminal and the grounding portion, and a second storage space is defined and enclosed by the second short portion, the second notch and the grounding portion; and a second coupling portion; wherein the second coupling portion is received in the second storage space, a corner of the second coupling portion is electrically coupled to a second end of the second feeding portion, and the second coupling portion is electrically insulated from the second short portion and the grounding portion; and wherein the first coupling portion and the second coupling portion have different sizes.

2. The antenna device of claim 1, wherein the first end of the first feeding portion is a first feeding point to feed signals; the first end of the second feeding portion is a second feeding point to feed signals; and the first feeding portion and the second feeding portion are parallel to each other.

3. The antenna device of claim 1, wherein the second short portion has an arch shape.

4. The antenna device of claim 3, wherein edges of the second coupling portion and the second short portion form gaps therebetween.

5. The antenna device of claim 1, wherein the first short portion has an arch shape.

6. The antenna device of claim 5, wherein edges of the first coupling portion and the first short portion form gaps therebetween.

7. The antenna device of claim 1, wherein the main short portion has an arch shape; two ends of the main short portion are electrically coupled to the grounding portion.

8. The antenna device of claim 1, wherein the first short portion comprises a first short segment extending away from the grounding portion in a predetermined direction and being electrically coupled to the grounding portion, a second short segment extending toward the grounding portion, and a third short segment extending substantially perpendicular to the predetermined direction and connecting each of the first short segment and the second short segment, the first notch is defined between the second short segment and the grounding portion, and the first storage space is further defined and enclosed by the first short segment, the third short segment, the second short segment, the first notch and the grounding portion.

9. The antenna device of claim 8, wherein the first coupling portion is located between the first short segment and the second short segment, and between the second terminal and the third short segment.

10. The antenna device of claim 8, wherein the first coupling portion is entirely received in the first storage space.

11. The antenna device of claim 1, wherein the second short portion comprises a fourth short segment extending away from the grounding portion in a predetermined direction and being electrically coupled to the grounding portion, a fifth short segment extending toward the grounding portion, and a sixth short segment extending substantially perpendicular to the predetermined direction and connecting each of the fourth short segment and the fifth short segment, the second notch is between the fifth short segment and the grounding portion, and the second storage is further defined and enclosed by the fourth short segment, the sixth short segment, the fifth short segment, the second notch and the grounding portion.

12. The antenna device of claim 11, wherein the second coupling portion is located between the fourth short segment and the fifth short segment, and between the fourth terminal and the sixth short segment.

13. The antenna device of claim 11, wherein the second coupling portion is completely located entirely received in the second storage space.

14. An antenna device, comprising:

a first antenna in a PCB to radiate signals;

a second antenna in the PCB to radiate signals;

a grounding portion; and a main short portion between the first antenna and the second antenna, the main short portion electrically coupled to the grounding portion; wherein the main short portion adjusts current between the first antenna and the second antenna, thereby the main short portion reduces interference between the first antenna and the second antenna;

wherein the first antenna comprises:

a first feeding portion, the first feeding portion comprising a first end, the first end being a free end;

a first short portion comprising a first terminal electrically coupled to the grounding portion, and a second terminal, the second terminal being a free end, wherein a first notch is defined between the second terminal and the grounding portion, and a first storage space is defined and enclosed by the first short portion, the first notch and the grounding portion; and a first coupling portion; wherein the first coupling portion is received in the first storage space, a corner of the first coupling portion is electrically coupled to a second end of the first feeding portion, and the first coupling portion is electrically insulated from the first short portion and the grounding portion;

wherein the second antenna comprises:

a second feeding portion, the second feeding portion comprising a first end, the first end being a free end;

a second short portion comprising a third terminal electrically coupled to the grounding portion, and a fourth terminal, the fourth terminal being a free end, wherein a second notch is defined between the fourth terminal and the grounding portion, and a second storage space is defined and enclosed by the second short portion, the second notch and the grounding portion; and a second coupling portion; wherein the second coupling portion is received in the second storage space, a corner of the second coupling portion is electrically coupled to a second end of the second feeding portion, and the second coupling portion is electrically insulated from the second short portion and the grounding portion; and wherein the first coupling portion and the second coupling portion have different contours.

15. An antenna device, comprising:

a first antenna in a PCB to radiate signals;

a second antenna in the PCB to radiate signals;

a grounding portion; and a main short portion between the first antenna and the second antenna, the main short portion electrically coupled to the grounding portion; wherein the main short portion adjusts current between the first antenna and the second antenna, thereby the main short portion reduces interference between the first antenna and the second antenna;

wherein the first antenna comprises:

a first feeding portion, the first feeding portion comprising a first end, the first end being a free end;

a first short portion comprising a first terminal electrically coupled to the grounding portion, and a second terminal, the second terminal being a free end, wherein a first notch is defined between the second terminal and the grounding portion, and a first storage space is defined and enclosed by the first short portion, the first notch and the grounding portion; and a first coupling portion; wherein the first coupling portion is received in the first storage space, a corner of the first coupling portion is electrically coupled to a second end of the first feeding portion, the first coupling portion is electrically insulated from the first short portion and the grounding portion, and a first distance is defined between the first coupling portion and the grounding portion;

wherein the second antenna comprises:

a second feeding portion, the second feeding portion comprising a first end, the first end being a free end;

a second short portion comprising a third terminal electrically coupled to the grounding portion, and a fourth terminal, the fourth terminal being a free end, wherein a second notch is defined between the fourth terminal and the grounding portion, and a second storage space is defined and enclosed by the second short portion, the second notch and the grounding portion; and a second coupling portion; wherein the second coupling portion is received in the second storage space, a corner of the second coupling portion is electrically coupled to a second end of the second feeding portion, the second coupling portion is electrically insulated from the second short portion and the grounding portion, and a second distance is defined between the second coupling portion and the grounding portion; and wherein the first distance is not equal to the second distance.

* * * * *